United States Patent [19]

Hata

[11] Patent Number: 4,993,639

[45] Date of Patent: Feb. 19, 1991

[54] MIST SPRAYER

[76] Inventor: Mitsuo Hata, 524 Nishihirajima, Okayama-shi, Okayama-ken, Japan

[21] Appl. No.: 417,243

[22] Filed: Oct. 4, 1989

[51] Int. Cl.[5] ..... B05B 7/24

[52] U.S. Cl. ..... 239/289; 239/345; 239/346; 239/355; 15/328

[58] Field of Search ..... 239/289, 344, 345, 351, 239/355, 369, 371, 375–379; 15/320, 321, 328, 405; 222/630

[56] References Cited

U.S. PATENT DOCUMENTS

| | | | |
|---|---|---|---|
| 1,370,687 | 3/1921 | Ferris | 239/345 |
| 2,275,691 | 3/1942 | Simanton | 239/355 |
| 2,901,182 | 8/1959 | Cragg et al. | 239/345 |
| 4,403,371 | 9/1983 | Kiyooka | 15/328 |

*Primary Examiner*—Andres Kashnikow
*Assistant Examiner*—Karen B. Merritt
*Attorney, Agent, or Firm*—Koda and Androlia

[57] ABSTRACT

A mist sprayer including an air blower, a spray head having a spray opening at a front end thereof and attached to the air blower, and a mist liquid vessel attached to the spray head. The spray head comprises a vessel attachment section to which the vessel is attached, and a spray tube provided inside the front of the spray head. A liquid intake at one end of the spray tube is opened in the vessel attachment section and a nozzle thereof at other end is positioned near the outlet of the spray head. An air hole is opened in the vessel attachment section to let air inside the vessel.

12 Claims, 2 Drawing Sheets

MIST SPRAYER

BACKGROUND OF THE INVENTION

1. Field of the Invention

The present invention relates to a compact, light-weight, easy-to-handle mist sprayer which can also be used as an air blower.

2. Prior Art

One type of light-weight mist sprayer is described in Japanese Utility Model Publication No. 62-12436. This sprayer is attached to an air blower which is used as a cleaning device by creating a strong air jet to blow away dirt in factories, etc.

However, this type of blower cannot be used as an air blower when a mist sprayer is attached thereto. In other words, a blower with a mist sprayer attached thereto cannot be directly switched from the mist sprayer mode to the air blower mode. The reason for this is that in order to stop chemical spraying (spray mode), it is necessary to close the cock of the device, and when the cock is closed, it is necessary to temporarily halt the job and lay the blower and chemical liquid tank on the ground.

Furthermore, since the blower and the chemical liquid tank are not an integral single unit, each part must be held in one hand during spray work. Thus, it is difficult to obtain satisfactory working results in the mist spray mode and it is especially difficult to aim at the target when spraying upward.

SUMMARY OF THE INVENTION

Accordingly, it is an object of the present invention to solve the problems found in the prior art and provide a sprayer device which can be switched back and forth between the air blower mode and mist sprayer mode at any time with good working characteristics.

The object of the present invention is accomplished by a unique structure of a mist sprayer which includes: an air blower creating an air blow; a cylindrical mist spray head removably attached to an opening of the blower; and a vessel which holds a mist liquid therein and is set on the spray head. The spray head includes a round vessel attachment section whose axis is perpendicular to the axis of the spray head; a spray tube provided on a partition wall which separates the inside of the spray head from the vessel attachment section, a liquid intake of the spray tube opening in the vessel attachment section and a nozzle or outlet portion thereof being in the vicinity of the spray opening of the spray head; and an air hole formed in the vessel attachment section which supplies air to the vessel.

With the structure described above, the spray head is attached to the opening of the blower, and a vessel which holds a liquid therein is set on the spray head with its opening fitted in the vessel attachment section of the spray head. When the vessel is positioned up-side-down on the spray head, the sprayer is in the sprayer mode. This mode is changed to the air blower mode by merely turning the blower 180 degree so that the vessel is underneath the spray head. Reversely, the air blower mode can be changed to the mist sprayer mode by merely turning the blower so that the vessel is up-side-down above the spray head.

In the above described mist sprayer, the vessel attachment section is provided near the spray opening, and the liquid intake of the spray tube, which passes through the partition wall of the spray head and opens in the vessel attachment section, is located in the front area of the partition wall. An air hole is located at the back of the liquid intake.

Also, the nozzle or outlet of the spray tube is located at the front end of the spray tube so that it projects out of the spray opening of the spray head.

Furthermore, the position of the air hole, when viewed from the top, is behind the liquid intake of the spray tube so that air can be smoothly supplied to the vessel when it is attached to the spray head.

Also, if a spring pin is inserted in the spray tube of the spray head, the volume of the spray tube may be easily changed.

Due to the unique design of the mist sprayer of the present invention as described in the above, when the vessel mounted on the spray head is positioned on the spray head (in other words when the vessel is up side down) the mist liquid in the vessel is fed into the spray tube and is sprayed out of the nozzle or outlet at the tip of the spray tube by the air from the blower ("sprayer mode"). When the blower is turned 180 degrees so that the vessel is positioned underneath the spray head which is positioned with its opening facing up, the liquid is not fed into the spray tube, and the mist sprayer acts as a simple air blower ("blower mode").

When the sprayer is in the sprayer mode, air taken into the up-side-down vessel through the air hole reaches a space above the mist liquid level inside the up-side-down vessel, and this space is kept at atmospheric pressure Thus, the mist liquid is continuously taken into the spray tube through the liquid intake without any interruption, continuing spraying action.

Since the spray tube is short and is nearly perpendicular when the sprayer is in the sprayer mode, the liquid can flow downward smoothly. In particular, downward flow is not obstructed even the mist liquid has a high viscosity.

When no air is supplied by the blower with the sprayer in the sprayer mode, the mist liquid dripping from the nozzle or outlet of the spray tube may fall outside the spray opening of the spray head. Thus, the interior of the mist spray head is kept clean.

The sprayer can be switched from the sprayer mode to the blower mode by merely turning the device up-side-down (that is, bringing the vessel to the top side of the spray head); and in this case the initiation of mist spraying is slightly delayed with reference to the speed of the switching action. Accordingly, preparation of working condition can be adjusted during this interval.

When the spring pin is placed in the spray tube, the internal volume of the spray tube is altered to meet the viscosity of the mist liquid without any need for a replacement of the spray tube for one of a different size.

DETAILED DESCRIPTION OF THE INVENTION

The mist sprayer of the present invention includes a blower 1, a mist spray head 2 which is connected to the blower 1, and a vessel 3 attached to the mist spray head 2.

Figure 3:
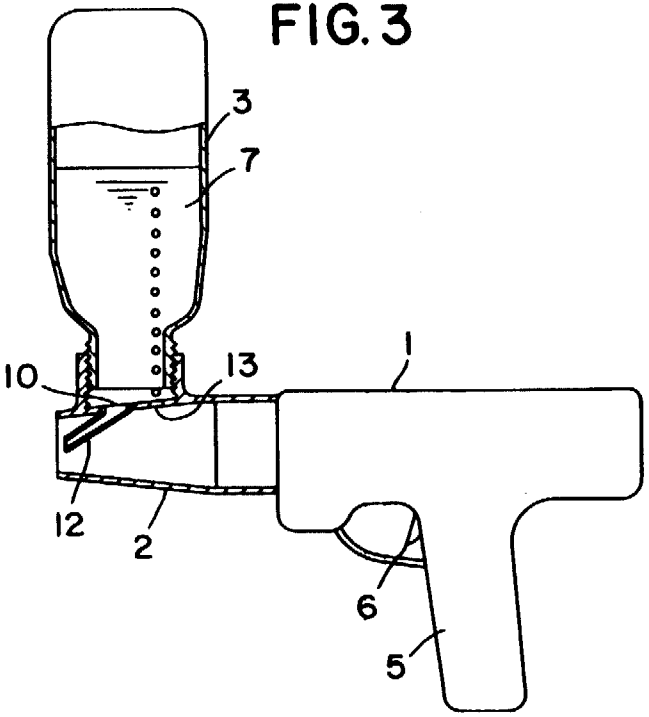

The blower 1 includes a fan (not shown) rotated by a motor (not shown) driven by a household power supply. The blower 1 may be an ordinary cleaning device which blows away dirt, etc. The blower further includes a handle 5 so that the blower 1 may be handheld. A switch 6 near the handle 5 is for turning the motor of the blower 1 on and off. FIG. 3 shows a pistol shape cordless blower used in the present invention which is driven by a rechargeable battery. In this case, a power cord is not required.

The spray head 2 having a spray opening 14 at the front end is provided with a vessel attachment section 8. The vessel attachment section 8 is round, and its axis is roughly perpendicular to the axis of the mist spray head 2, projecting upward on the spray head 2. The vessel 3 is mounted on the spray head 2 with its opening fit in the vessel attachment section 8.

Figure 2:
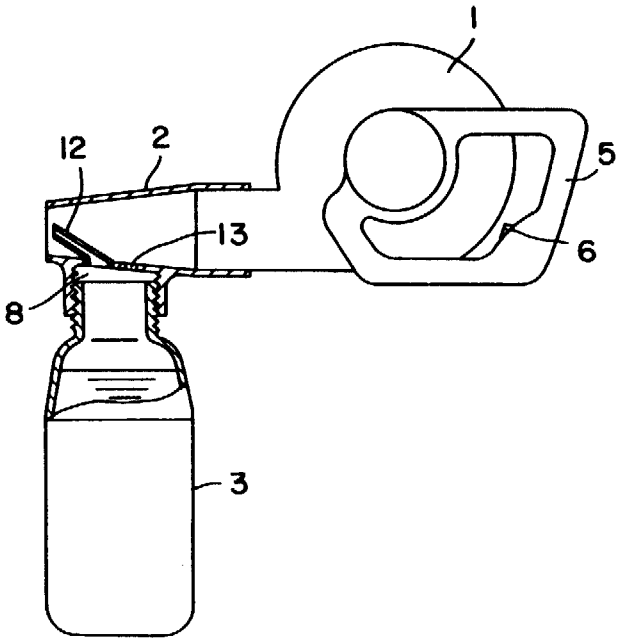
FIGS. 1, 2 and 3 are partial sectional side views of the mist sprayer of the present invention.
Figure 1:
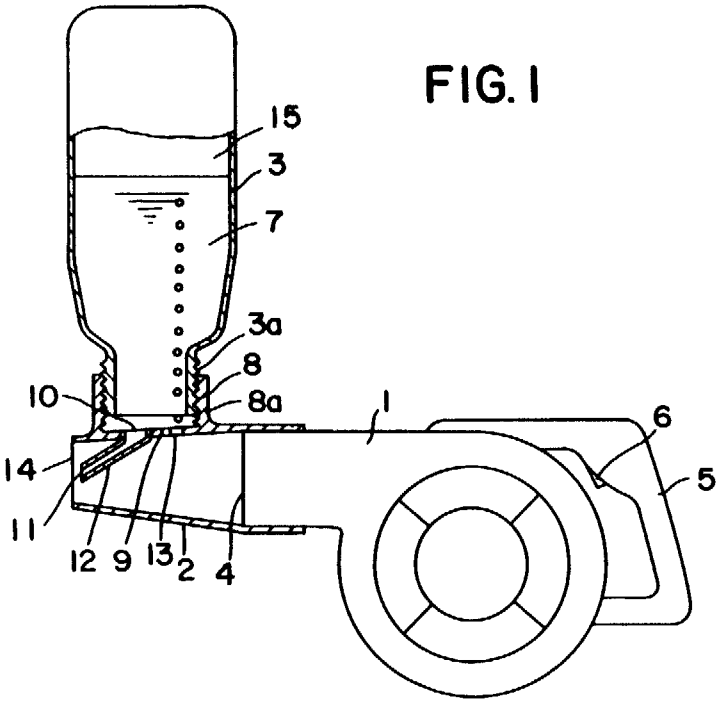

It is desirable to provide the vessel attachment section opening 8 so that it faces up when the spray head 2 is attached to a blower end 4 of the blower 1 and the handle 5 is in its normal position as shown in FIG. 1.

The vessel attachment section 8 is internally threaded as indicated by 8*a*, and the mouth of the vessel 3 is externally threaded as indicated by 3*a*. Thus, the vessel 3 and the vessel attachment section 8 are firmly fastened together via the threads 3*a* and 8*a*.

The mist spray head 2 is further provided with a spray tube 12. The spray tube 12 has a liquid intake 10 at one end, and the intake 10 is provided through a partition wall 9 of the spray head 2 and opens in the vessel attachment section 8. At the other end, the spray tube 12 has a nozzle 11 which is positioned near the spray opening 14. The spray tube 12 is short and gradually narrows toward the nozzle or outlet 11.

The partition wall 9 separates the vessel attachment section 8 from the interior of the mist spray head 2 and is at the bottom of the vessel attachment opening 8.

Reference numeral 13 is an air hole which is provided in the partition wall 9. The air hole 13 is for supplying air into the vessel 3 therethrough and is provided behind the intake 10 of the spray tube 12.

Figure 4:
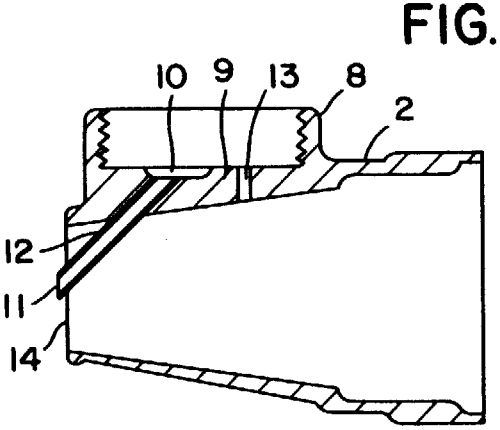
FIG. 4 is a sectional view of a mist spray head used therein.

It is preferable to position the nozzle or outlet 11 in the vicinity of the spray opening 14 which is at the tip end of the mist spray head 2. The nozzle or outlet 11 may project so that it is outside of the spray opening 14 as shown in FIG. 4. Such an arrangement is advantageous in that the mist liquid 7 flowing downward in the vessel 3 and dripping out from the nozzle or outlet 11 is prevented from falling inside the mist spray head 2, thus avoiding contamination of the spray head 2. The liquid intake 10 of the spray tube 12 is positioned close to the front area of the vessel attachment section 8. The spray tube 12 is designed so that it is short and provided so as to be axially vertical to the spray head 12, so that the mist liquid 7 flows downward smoothly in the vessel 3. Such an arrangement is especially effective when the mist liquid 7 is of a high viscosity, and for this reason, the air hole 13 is provided at the back of the liquid intake 10.

It is also desirable that the air hole 13 is provided further back (when viewed from the top) so that it is behind the intake 10 in the direction of rotation of the vessel 3. More specifically, the position of the air hole 13 (i.e., the position of the air hole 13 viewed from the top) is behind the liquid intake 10 of the spray tube 12 in the direction of rotation around the axis of the cylindrical spray head (i.e., the direction in which the device is rotated to convert the air blower mode into the mist spray mode and vise versa).

Figure 6:
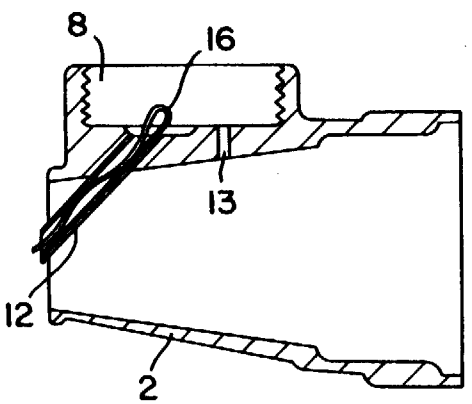
FIG. 6 is a sectional view of another embodiment of the mist spray head.

FIG. 6 shows a longitudinal section of another embodiment of the mist spray head 2. In this embodiment, a spring pin 16 is inserted in the spray tube 12 so as to be removed. With this spring pin 16 inserted, the internal volume of the spray tube 12 can be reduced, and excessive flow of a low-viscosity mist liquid 7 can be prevented.

The vessel 3 attached to the spray head 2 is of a long, slender shape such as a large soft drink bottle so that it is easy to handle. It is not necessary to manufacture a special vessel suited to the spray head 2, and an empty soft drink bottle (preferably a plastic bottle, since such a bottle is light-weight) can be used "as is" as long as the diameter of the vessel attachment section 8 and the external threads of the bottle 3 match.

In operation, when the blower 1 is held so that the vessel 3 is under the spray head, no mist liquid 7 is fed into the spray tube 12. Accordingly, even if the blower 1 is switched on via the switch 6, the device merely acts as an air blower. In this case, there is no leakage of the mist liquid 7 from the vessel 3, because no hole or opening which lets air come into the vessel 3 is provided therein.

When the blower 1 is turned up-side-down as a unit along with the vessel 3 so that the vessel 3 is above the sprayer, the mist liquid 7 flows downward from the vessel 3 through the intake 10 of the spray tube 12. The liquid 7 reaches the nozzle or outlet 11 located at the tip end of the spray tube 12, drips from this nozzle or outlet 11 and is blown off by the air blowing force created by the motor of the blower 1. Thus, the device acts as a mist sprayer, that is, it is in the sprayer mode.

The air pressure in the space 15 formed between the bottom of the vessel 3 and the surface level of the mist liquid 7 in the vessel 3 can be gradually reduced as the mist liquid 7 flows out of the vessel 3. However, since air admitted via the air hole 13 rises through the mist liquid 7 in the form of bubbles and is thus constantly supplied to the space 15, the space 15 is maintained at an atmospheric pressure. Accordingly, the mist liquid 7 can continuously drip from the nozzle or outlet 11 and the mist continues being sprayed out until all the mist liquid 7 is used up.

Figure 5:
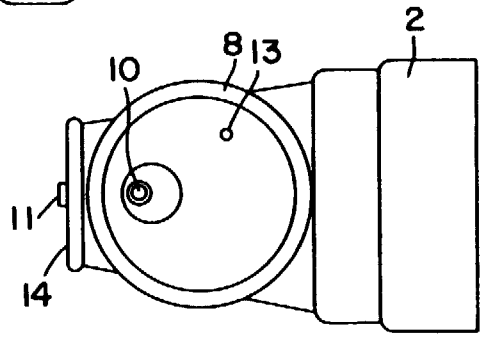
FIG. 5 is a top view of the mist spray head.

Since the air hole 13 (as shown in the plan view) is positioned behind the intake 10 (see FIGS. 4 and 5) when the blower 1 is turned about its axis to change from the air blower mode to the sprayer mode (Note that mode change of the device is more easily executed when the device is rotated clockwise as viewed from the front; accordingly, this direction is designated as the direction of rotation.), spraying of the mist liquid 7 is delayed as the air is going up in the liquid 7 in the vessel 3, when the vessel 3 is rotated to be brought above the spray head 2. This is convenient in that it allows the working condition to be made ready during this interval.

As described above in detail, the spray tube 12 in the mist sprayer of the present invention is short and nearly vertical to the axis of the spray head 2, and the air blow from the blower 1 is strong. Accordingly, liquids used in this mist sprayer are not limited to low-viscosity liquids such as ordinary chemicals, and high-viscosity liquids such as mortar, paints and oils, etc., can also be sprayed out without clogging the spray tube 12. Thus, the sprayer of the present invention can be used as a combination mist sprayer and air blower so that chemicals for extermination of pests such as termites and cockroaches, chemicals for horticultural and agricultural work, protective liquids which prevent the scattering of asbestos, and detergents used to clean screen doors may be sprayed out. The sprayer can also be used for blowing mortar in construction sites, spraying paints and oils to prevent rusting, etc.

The mist sprayer of the present invention has the following merits:

I. The vessel 3 is long and slender, and when it is attached to blower 1, it is positioned perpendicular to the axes of the cylindrical spray head 2 and the blower 1. Thus, the blower 1 can be held by the right hand and the vessel 3 by the left hand during the spraying action. Accordingly, the mist sprayer of the present invention is extremely easy to operate and is easy to aim at the target during mist spraying work.

II. Since switching between the air blower mode and mist sprayer mode is accomplished by merely shifting the position of the vessel 3 (that is, above or below the spray head) by rotating it along with the blower 1 around the axis of the blower 1, two types of work (air blowing and mist spraying) may be easily exchanged at any time without any need of turning a cock, etc.

III. Since the spray tube 12 is short and nearly vertical in orientation to the cylindrical spray head 12, even a high-viscosity mist liquid can be sprayed out without any blockage in the mist sprayer.

IV. Prior art atomizers and mist sprayers require pressure mechanisms, a connecting structure between the spray opening and vessel (tank), and a chemical atomizing mechanism, etc. However, in the present invention these elements are replaced by a simple structure which substantially includes the spray tube 12 and the air hole 13. Thus, the mist sprayer of the present invention is simple in structure, light in weight, easy to operate and inexpensive to manufacture.

V. The distance between the nozzle or outlet 11 of the spray tube 12 and the spray opening 14 of the mist spray head 2 is designed to be short. That is, they are positioned close to each other. Accordingly, the mist liquid 7 tends not to drop and adhere to the interior of the mist spray head 2. This is especially true if the nozzle or outlet 11 is projected from the spray opening 14 (as seen in FIG. 4), the mist liquid 7 will not adhere to the interior of the mist spray head 2 even if the mist liquid 7 should drip from the nozzle or outlet 11.

VI. Since the mist liquid 7 is fed out from the spray tube 12 and sprayed out by a high-velocity air blow made by the blower 1, the mist liquid 7 can be sprayed for a long distance. Furthermore, even if the amount of the mist liquid 7 is small, the spray distance is not affected, and last drop of the mist liquid 7 can be used.

VII. The position of the air hole 13 for letting air into the vessel 3 (i.e., the position of the air hole 13 viewed from the top) is behind the liquid intake 10 in the direction of rotation around the axis of the cylindrical spray head 2 (i.e., the direction in which the device is rotated to convert the air blower mode to the mist spray mode), initiation of mist spraying tends to lag behind the rotational action of the blower 1. Accordingly, working conditions can be adjusted during this interval.

VIII. When the spring pin 16 is inserted the spray tube 12, the internal volume of the spray tube 12 is changed so as to meet the differences in the viscosity of the mist liquid 7.

I claim:

1. A mist sprayer and a means for blowing air characterized in that:

(a) a vessel attachment section is formed in a cylindrical mist spray head connected to a blast opening of an air blower, so that said attachment section is perpendicular to the axis of said head; (b) a long, slender vessel which accommodates a mist liquid is attached to said vessel attachment section so that said vessel can be freely attached or removed, said vessel being provided above said axis; (c) a spray tube is provided so that it extends from said vessel attachment section through a partition wall which separates the interior of said mist spray head from said vessel attachment section and to the vicinity of a spray opening which is locate at the tip of said mist spray head; and (d) a hole formed in said partition wall which allows the passage of air; whereby said mist sprayer may be used as a means for blowing air by rotating said vessel about said axis of said head to a position wherein said vessel is below said axis.

2. A mist sprayer and a means for blowing air according to claim 1 characterized in that a distance from said vessel attachment section to said spray opening is a minimum, the liquid intake of said spray tube which passes through said partition wall is located at a front area of said partition wall, and said air hole is provided rearward of said liquid intake.

3. A mist sprayer and a means for blowing air according to claim 1 or 2, said sprayer being characterized in that a nozzle located at a tip end of said spray tube projects further forward than said spray opening.

4. A mist sprayer and a means for blowing air according to claim 1 or 2, said sprayer being characterized in that said air hole is positioned rearward with respect to the position of said liquid intake when viewed from the top in the direction of said axis.

5. A mist sprayer and means for blowing air according to claim 1 or 2, characterized in that said mist sprayer is constructed so that internal volume of said spray tube can be altered by inserting a spring pin in said spray tube.

6. A mist sprayer and a means for blowing air according to claim 3, said sprayer being characterized in that said air hole is positioned rearward with respect to the position of said liquid intake when viewed from the top in the direction of said axis.

7. A mist sprayer and a means for blowing air according to claim 3, characterized in that said mist sprayer is constructed so that internal volume of said spray tube can be altered by inserting a spring pin in said spray tube.

8. A mist sprayer and a means for blowing air according to claim 4, characterized in that said mist sprayer is constructed so that internal volume of said spray tube can be altered by inserting a spring pin in said spray tube.

9. A mist sprayer and a means for blowing air according to claim 6, characterized in that said mist sprayer is constructed so that internal volume of said spray tube can be altered by inserting a spring pin in said spray tube.

10. A mist sprayer and a means for blowing air comprising an air blower having a blast opening, a spray head having a spray opening at a front end thereof and attached to said blast opening of said air blower at an other end, and a vessel containing therein a mist liquid, wherein said spray head comprising:

a vessel attachment section to which said vessel is attached at its mouth portion, said vessel being positioned above said vessel attachment section in a spraying mode and below said vessel attachment section in an air blowing mode;

a spray tube provided inside front of said spray head, a liquid intake of said spray tube being opened in said vessel attachment section and an outlet thereof being in the vicinity of said spray opening; and an air hole provided in said vessel attachment section through which air passes into said vessel.

11. A mist sprayer and a means for blowing air according to claim 10, wherein said outlet of said spray tube projects out of said spray opening of said spray tube.

12. A mist sprayer and a means for blowing air according to claim 11, further comprising a spring pin provided in said spray tube.

* * * * *